US006286218B1

(12) United States Patent
Lüttgens

(10) Patent No.: US 6,286,218 B1
(45) Date of Patent: Sep. 11, 2001

(54) SHARPENER, IN PARTICULAR FOR SOFT-CORE PENCILS

(75) Inventor: Fritz Lüttgens, Erlangen (DE)

(73) Assignee: KUM Limited, Dublin (IE)

( * ) Notice: Subject to any disclaimer, the term of this patent is extended or adjusted under 35 U.S.C. 154(b) by 0 days.

(21) Appl. No.: 09/368,646

(22) Filed: Aug. 5, 1999

(30) Foreign Application Priority Data

Sep. 4, 1998 (DE) ..... 198 40 309

(51) Int. Cl.[7] ..... B43L 23/08
(52) U.S. Cl. ..... 30/454; 30/451; 144/28.11
(58) Field of Search ..... 30/451, 453, 454, 30/457; 144/28.1, 28.11

(56) References Cited

U.S. PATENT DOCUMENTS

| | | | | |
|---|---|---|---|---|
| 1,728,774 | * | 9/1929 | Stone | 144/28.11 |
| 1,916,889 | * | 7/1933 | Moulton et al. | 30/451 |
| 2,514,761 | * | 7/1950 | Havnen | 144/28.11 |
| 4,158,912 | * | 6/1979 | Erdmann | 30/454 |
| 4,513,798 | * | 4/1985 | Luttgens | 144/28.11 |
| 4,755,074 | * | 7/1988 | Roberts | 144/28.11 |
| 5,647,138 | * | 7/1997 | Tang et al. | 30/454 |
| 5,845,406 | * | 12/1998 | Luttgens | 30/454 |

FOREIGN PATENT DOCUMENTS

| | | | | |
|---|---|---|---|---|
| 364 501 | | 11/1922 | (DE) . | |
| 471 515 | | 2/1929 | (DE) . | |
| 2819134 | * | 11/1979 | (DE) | 144/28.11 |
| 29 53 022 A1 | | | | |
| U | | 4/1981 | (DE) . | |
| 31 45 536 C2 | | 5/1983 | (DE) . | |
| 297 23 492 U | | 10/1998 | (DE) . | |
| 973003 | | 2/1951 | (FR) . | |
| 994071 | | 6/1965 | (GB) . | |
| 2035910 | * | 6/1980 | (GB) | 144/28.11 |
| 2 114 940 | | 9/1983 | (GB) . | |

* cited by examiner

*Primary Examiner*—Hwei-Siu Payer
(74) *Attorney, Agent, or Firm*—Herbert L. Lerner; Laurence A. Greenberg; Werner H. Stemer

(57) ABSTRACT

A sharpener contains a housing having a receiving channel for a pencil which is to be sharpened. The sharpener is intended to be seated as a protective cap, when the pencil is not in use, with a clamping fit on the pencil circumference. The clamping connection necessary for this purpose is an external clamping-force producer which can be removed manually from acting on the housing, in particular a cleaning stick, with, for the purpose of providing the clamping force, is for example a pressure-exerting lug in the form of a wedge or with an eccentric.

17 Claims, 3 Drawing Sheets

SHARPENER, IN PARTICULAR FOR SOFT-CORE PENCILS

BACKGROUND OF THE INVENTION

Field of the Invention

The invention relates to a sharpener for shaping the use end of a pencil-like marking implement.

Such a sharpener has a sharpener housing or a housing body having a shaping device, which is usually configured as a metallic sharpening blade. The sharper further has a receiving channel, which tapers conically usually starting from an introduction end and is intended for the use end of the marking implement or marking pencil. The latter is, in particular, a soft-core pencil that is used particularly frequently as a cosmetic pencil. However, it may also be a normal pencil for writing purposes or a core without a casing because, for example, a wooden or plastic casing is not an absolutely essential constituent part of a marking implement.

It is known from Published, Non-Prosecuted German Patent Application DE 29 53 022 A1 to fix such a sharpener as a protective cap, when it is not in use, with a clamping fit on the pencil circumference or use end, in order to encase the latter or the tip of the marking pencil and to screen it in the outward direction. Serving as a clamping connection device in the case of the sharpener are a number of retaining tongues which are integrally formed at the introduction end of the receiving channel for the use end of the marking pencil and can be deflected resiliently in the radially outward direction. The retaining tongues produce the normal force necessary for the friction of the clamping connection. The clamping connection system is thus one with an elastic spring force as an internal, dedicated force producer that is permanently active. This has the considerable disadvantage that, during the sharpening operation, first of all the friction fit provided by the internal clamping-force producer has to be overcome before the marking pencil can be turned for the actual sharpening operation in the sharpener.

It is also known, in the case of the sharpener, for the sharpening end of the latter, and thus in particular the space thereof which encloses the outlet slit for the sharpening shavings, to be covered by a releasable closure cap which thus acts as a shaving collector. With the closure cap attached, the latter ensures that the sharpener encloses the sensitive tip of the marking pencil, and the shaving waste produced during sharpening, and protects the surroundings from undesired contact with the shaving waste and the pencil or core tip.

Further sharpeners which, when not in use, likewise fulfill the additional function of protecting the tip of the marking implement or core are known from U.S. Pat. No. 2,514,761 and from British Patent No. GB 994 071. The clamping connection provided for this purpose is likewise based on internal clamping-force producers which belong to the sharpener housing and act in a manner similar to the subject matter of the Published, Non-Prosecuted German Patent-Application DE 29 53 022 A1.

A sharpener which can be used in the same way, when not in use, as a protective cap for the tip of a cosmetic pencil and can be attached to the latter with an adhering or friction fit is also known from German Patent No. DE 31 45 536 C2, corresponding to U.S. Pat. No. 4,513,798. The sharpener is provided with a receiving device for a cleaning stick which, in the received position, projects into the interior of the shaving-collecting cap and can thus fulfill a further function. The receiving opening for the cleaning stick serves as a quiver in order that, when not in use, the cleaning stick is kept available in a captive and easy-to-grip manner and its often soiled cleaning end is screened from the surroundings. In this position, it has the further function of removing pasty shaving waste adhering to the inside of the shaving-collecting cap when the latter is removed.

SUMMARY OF THE INVENTION

It is accordingly an object of the invention to provide a sharpener, in particular for soft-core pencils that overcomes the above-mentioned disadvantages of the prior art devices of this general type, such that, in a resting state, a clamping connection of the sharpener ensures improved adherence to the marking pencil, but does not obstruct the sharpening operation.

With the foregoing and other objects in view there is provided, in accordance with the invention, a sharpener for shaping a use end of an item to be sharpened, including a housing having a receiving channel formed therein for receiving a use end of a marking implement having a shank; a blade-shaped sharpener disposed in the housing for shaping the marking implement; and a manually removable external clamping-force producer acting on the housing, the housing being seated as a protective cap, when not in use, with a clamping fit on the shank of the marking implement.

The object is achieved according to the invention in that the clamping connection provided is an external, and thus separate, clamping-force producer which can be separated manually from the housing. This does away with any obstruction of the sharpening operation by the clamping connection during sharpening operations because the latter is separate from the housing. In the use position on the housing, however, the separate clamping-force producer may be configured such that it actively blocks any release of the pencil from the sharpener. This does away with the risk of undesired release with the resulting soiling, which is extremely undesirable, and the associated risk to the core or pencil tip.

In a particularly expedient configuration, the external clamping-force producer is a cleaning stick and/or a shaping device for the core tip and thus a functional part that has a second use. The clamping-pressure or clamping-force producer is not necessary during the sharpening operation itself. However, immediately following the sharpening operation, it may be used as a cleaning tool and/or for shaping the core tip at the end of the sharpening operation. This prevents the risk of loss if, in order to release the marking pencil from the sharpener, it is loosened or removed from its clamping or rest position on the sharpener. This is because, once the core-shaping or cleaning operation has been carried out and the sharpener has then been pushed onto the use or core end of the pencil, the cleaning stick or the shaping device is immediately pushed into its quiver-like retaining channel on the sharpener or sharpener housing and, in this active rest position or functional position, in which the sharpener housing is seated with a clamping fit on the pencil shank, causes the sharpener to be fixed particularly securely in its protective position on the marking pencil.

It is also possible for the clamping-force producer to be, for example, a reserve blade for the sharpener, the reserve blade bringing about the clamping force when inserted in the housing. Another second use may be provided in that the clamping-force producer is a retaining clip which is secured on the implement or pencil shank by one retaining end, and is similar to the resilient retaining lug of a pen or the like, for the purpose of pushing or inserting the pencil into, for example, a shirt or jacket pocket. In the rest position, the retaining clip has its free end side pushed into the retaining channel on the housing and, in turn, brings about the clamping force.

In an advantageous development, the clamping-force producer acts directly on the outside of the pencil. For this purpose, the clamping-force producer is configured at its additional functional end, which is directed away from the insertion end, as an eccentric which, depending on the rotary or pivot position, acts with clamping action on the outside or shank of the inserted marking pencil or releases the same for unobstructed rotary movement. On the other hand, however, indirect action is also possible in that the clamping-force producer deflects, for example, an intermediate wall, which is provided integrally on the housing, or a pressure-exerting tongue, in its blocking position, radially inward, i.e. in the direction of the receiving channel for the use end or the core tip of the marking pencil.

Other features which are considered as characteristic for the invention are set forth in the appended claims.

Although the invention is illustrated and described herein as embodied in a sharpener, in particular for soft-core pencils, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
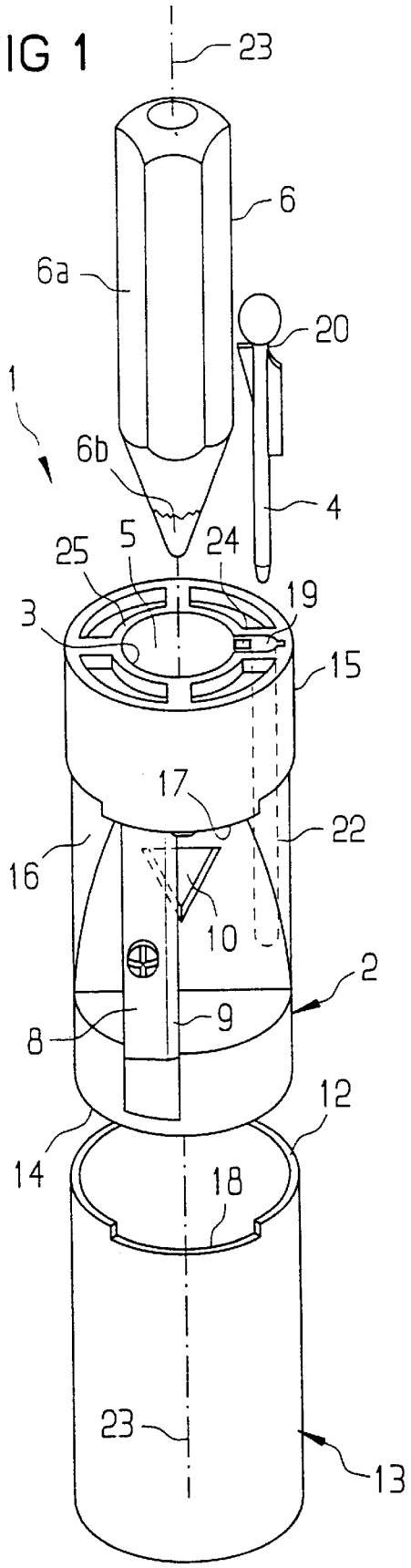
FIG. 1 is a diagrammatic, exploded, perspective view of a sharpener with, above it, a pencil which is to be sharpened and, beneath it, a shaving-collecting container and with a cleaning stick as a first embodiment of a clamping-force producer.

In all the figures of the drawing, sub-features and integral parts that correspond to one another bear the same reference symbol in each case. Referring now to the figures of the drawing in detail and first, particularly, to FIG. 1 thereof, there is shown a sharpener 1 having a sharpener housing or housing body 2 with a circular or, according to FIG. 7, preferably elliptical cross-sectional shape. The preferably plastic housing 2 contains, on its end side, an introduction opening 3 of a receiving channel 5 for a pencil-like marking implement, e.g. for a soft-core pencil, which, for the sake of simplicity, is referred to herein below just as a pencil 6. In an interior of the housing 2, the receiving channel 5 tapers conically to form a guide channel 7 (FIG. 5), which has the plane of a sharpening blade 8, as a shaping device for the pencil 6 or a tip 6*b* thereof, running at a tangent to it. The functioning of the blade 8 corresponds to the basic functioning known per se of a pencil sharpener.

The guide channel 7 is provided, above a cutting edge 9 of the sharpening blade 8, with an arrowhead-shaped outlet or through-passage opening 10 for sharpening or shaving waste. The through-passage opening 10 passes through the casing of the housing 2. In an assembled position, circumferential spaces 11 (FIG. 5) outside the housing casing, in a region of the conical guide channel 7, are enclosed by the annular casing 12 of a shaving-collecting container 13. The latter can be pushed onto the housing 2 from a housing side which is located opposite the introduction opening 3, or from an opposite end side 14 of the housing 2, by way of a circumferential casing 16 of the housing 2. The casing being set back radially in a step-like manner in relation to an introduction end 15, which has the introduction opening 3, and the shaving-collecting container can be fixedly connected or clipped to the circumferential casing of the housing 2. In this case, an axial protrusion 17 at the introduction end 15 of the housing 2 engages, as a rotation-prevention device, in a corresponding mating recess 18 of the casing 12 of the shaving-collecting container 13. The axial protrusion 17 and the mating recess 18 engage in one another in the manner of a groove and tongue. This extends an axial grip length for handling the sharpener 1.

An elliptical cross-sectional shape of the housing 2 and shaving-collecting container 13 according to FIGS. 2, 3 and 7 to 9 aids the ability to grip the sharpener 1 and makes it possible to do away with the rotation-prevention device 17, 18. The circumferential shape of the shaving-collecting container 13 is flush with the circumferential shape of the introduction end 15 of the sharpener housing 2. The elliptical cross-sectional shape particularly advantageously provides sufficient space for a quiver-like insertion opening 19 for a cleaning stick 20, 20', 21 and 21', according to FIGS. 1 and 2, 3, 4 and 5 as well as 7 and 8*a*, 8*b*, with a stick shank 4. The insertion opening 19 and an adjoining retaining channel 22—and thus the insertion and pivot axis of the stick shank 4—run approximately parallel to a center longitudinal axis 23 of the pencil 6, of the housing 2, of the sharpener 1 and the shaving-collecting container 13 thereof.

The first and second embodiments of the cleaning stick 20 and 20' act as a clamping-force producer server, in conjunction with the corresponding configuration of the sharpener housing 2, for clamping the pencil 6 indirectly, in its rest position, located within the receiving channel 5. For this purpose, the housing 2 contains, according to FIGS. 1 to 3, a pressure-exerting tongue 24 which is positioned in a recessed circumferential segment of a casing 25 of the receiving channel 5. The pressure-exerting tongue 24 is connected to the housing 2 by that end which is located within the receiving channel 5. To this extent, it is expediently injection molded from plastic integrally with the housing 2. It can thus be deflected radially in relation to the center longitudinal axis 23 of the receiving channel 5. This deflection is brought about by a wedge-like pressure-exerting lug 26, 26*a* on the shank 4 of the cleaning stick 20, 20' according to FIGS. 2 and 3, respectively. The pressure-exerting lug 26, 26*a* is a pressure-exerting wedge that tapers in an insertion direction 27.

Figure 2:
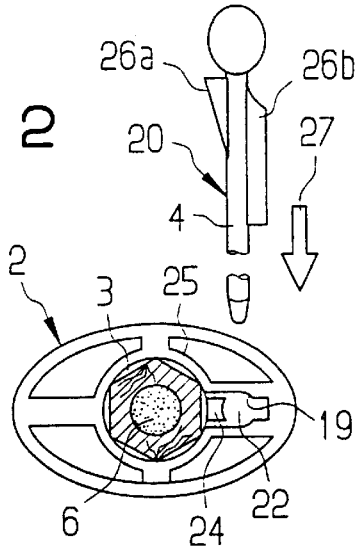
FIG. 2 is a plan view of an introduction end of the sharpener according to FIG. 1 with a sectionally illustrated pencil positioned in a receiving channel and the cleaning stick assigned to a sharpener housing in spatial terms.
Figure 3:
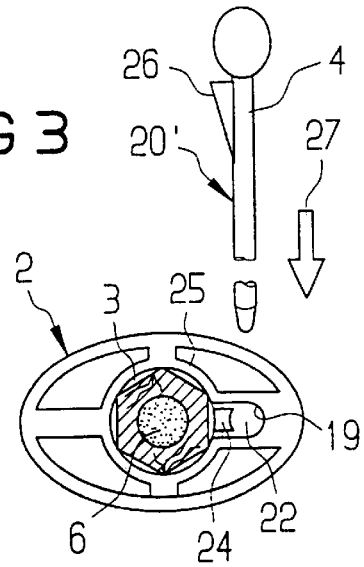
FIG. 3 is a plan view of the cleaning stick as a second embodiment of the clamping-force producer and a correspondingly formed retaining-channel cross section in the sharpener housing.

In the embodiment of the cleaning stick 20 according to FIGS. 1 and 2, the cleaning stick 20 has, on the shank side which is located opposite the pressure-exerting lug 26*a*, a further tab 26*b* which is likewise integrally formed on the stick shank 4 and can be used, for example, as a shaping part for the pencil, i.e. the pencil tip or core tip 6*a* thereof. As can be seen comparatively clearly in FIG. 2, the inner contour of the retaining channel 22 and of the insertion opening 19 which opens out into the latter is adapted to the outer contour of the stick 20, the outer contour being produced by the tab 26*b*.

The fact that the pressure-exerting lug 26, 26*a* acts indirectly on the outside or shank 6*a* of the pencil 6, with the interposition of the pressure-exerting tongue 24, has the advantage of precluding the outside of the pencil from being deformed in any way, as would be possible by excessive punctiform or linear clamping. This is important with cosmetic pencils, in the case of which great importance is attached to the aesthetically pleasing appearance thereof. Nevertheless, it is thus possible for the pencil 6 to be clamped securely within the receiving channel 5. Any escape of shaving waste from the receiving channel 5 is also prevented in an effective manner as a result.

Figure 9A:
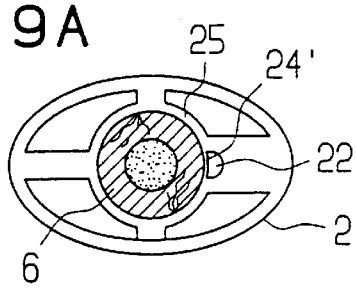
FIGS. 9*a* and 9*b* are plan views of a modified sharpener housing for subjecting the pencil shank indirectly to the action of pressure.
Figure 9B:
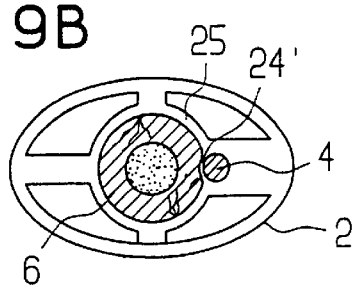

An alternative embodiment for subjecting the outside 6*b* of the pencil indirectly to pressure or clamping force is shown in FIGS. 9*a* and 9*b* with the clamping-force producer 20, 20' or the stick shank 4 respectively not inserted and inserted into the corresponding, quiver-like retaining channel 22. For this purpose, the latter is separated from the receiving channel 5 for the pencil 6, by a very thin intermediate wall 24', which likewise acts as a pressure-exerting tongue. When the preferably likewise stick-like clamping-force producer 20, 20' is inserted, the intermediate wall 24' is deformed in the direction of the receiving channel 5. It is also possible for the corresponding clamping-force producer 20, 20' additionally to have the stick shank 4 which is oval, elliptical or of some other eccentric shape, in order then to be able to realize, in comparison with the illustration in FIG. 9*a*, a less half-moon-shaped cross section, or even in turn a circular cross section, of the retaining channel 22 and of the insertion opening 19 in the housing 2.

Figure 4:
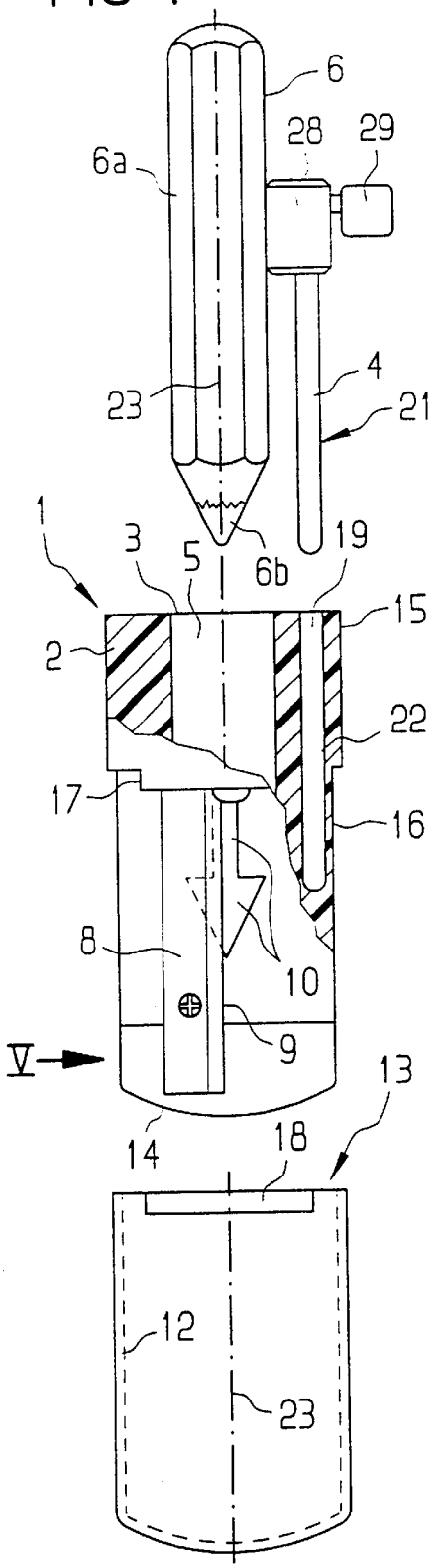
FIG. 4 is an exploded, partially sectional, side-elevational view analogous to FIG. 1 with exploded positioning of the individual parts which interact with one another during a sharpening operation, and with a third embodiment of the clamping-force producer for subjecting a pencil shank directly to an action of pressure.
Figure 5:
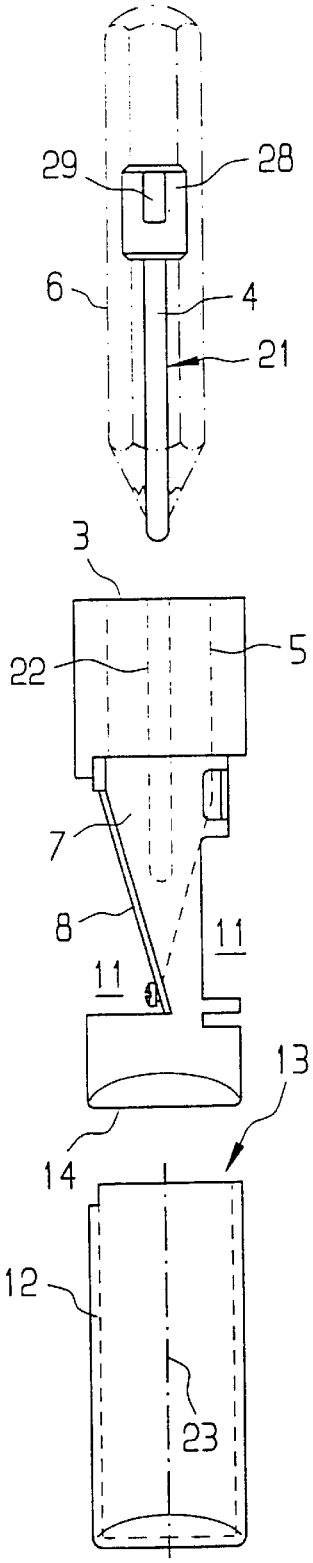
FIG. 5 an exploded, side-elevational view according to FIG. 4 as seen in a direction of an arrow V shown in FIG. 4.
Figure 6:
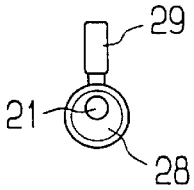
FIG. 6 is a plan view of the clamping-force producer according to FIGS. 4 and 5.

The embodiments illustrated in FIGS. 4 to 6 as well as 7 and 8 make use of direct clamping of the pencil 6 by an eccentric 28 or by an eccentric plate 28'. In the exemplary embodiment, the eccentric 28 is oval, at a grip end of the cleaning stick 21, according to a third embodiment, and 21', according to a fourth embodiment. The eccentric 28 according to FIG. 6 has a circular circumference, of which a center point of the circle and the longitudinal axis are respectively located alongside and parallel to the longitudinal direction of the cleaning stick 21. With the cleaning stick 21 in a position in which it is inserted into the retaining channel 22 (not illustrated), the eccentric 28 is still located outside the housing 2. It can easily be pivoted, by a grip rib 29, about the center longitudinal axis of the retaining channel 22, that receives the cleaning stick 21. As a result of which, in its position that is illustrated in FIGS. 4 and 5, the eccentric 28 subjects the outside or shank 6*a* of the pencil 6 to a clamping pressure. The clamping is eliminated by virtue of a rotation through approximately 90° by use of the grip rib 29, with the result that the pencil 6 can then be removed from the receiving channel 5 without difficulty.

Figure 7:
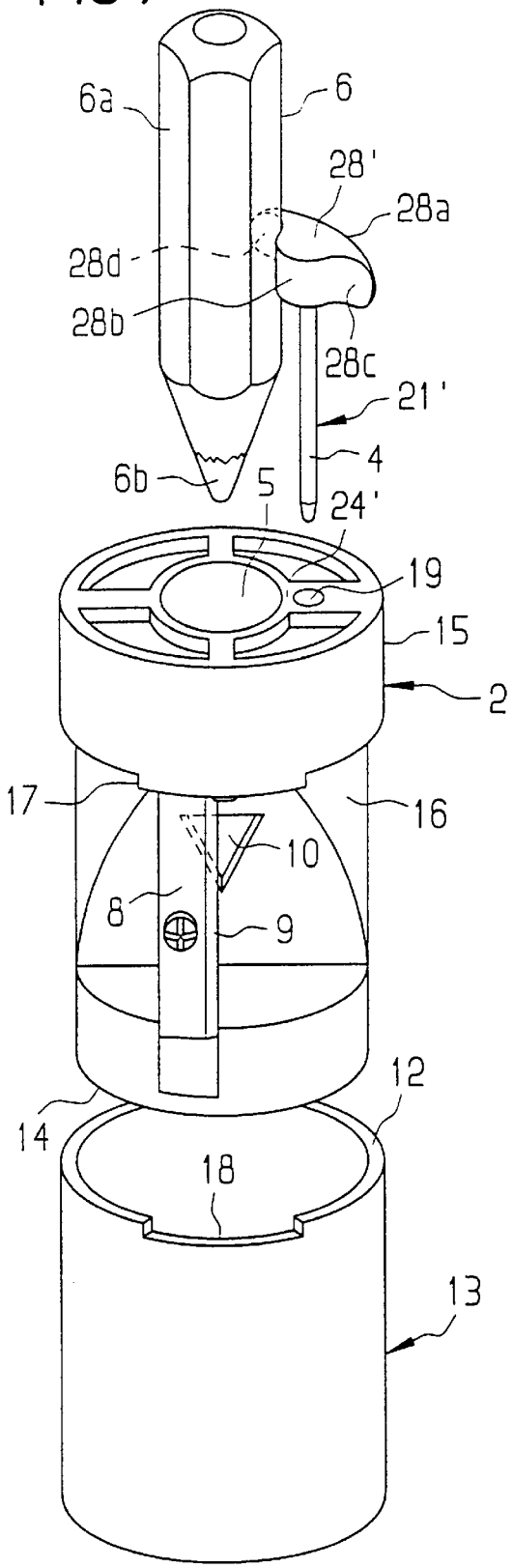
FIG. 7 is an exploded, perspective view according to FIG. 1 of the sharpener with an oval housing and with the cleaning stick, as a fourth embodiment of the clamping-force producer, with a stick head acting as an eccentric.
Figure 8A:
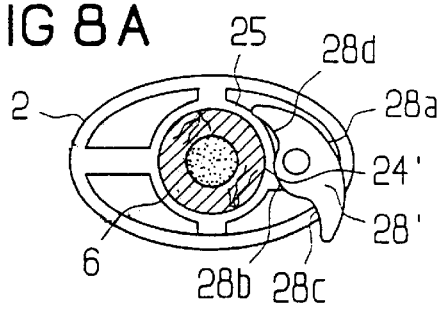
FIGS. 8*a* and 8*b* are plan views of the clamping-force producer according to FIG. 7 with the eccentric located in the open and clamping positions, respectively.
Figure 8B:
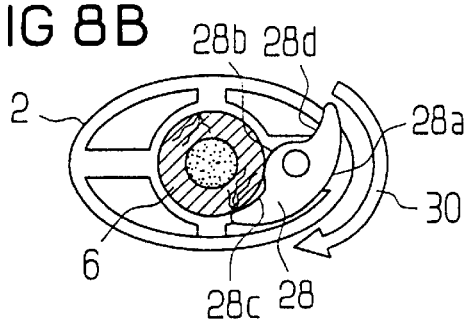

The cleaning stick or the clamping-force producer 21' according to the embodiment of FIGS. 7 and 8, with an oval head, has, in the center of the eccentric side which is located opposite a flat head side 28*a*, a projecting eccentric protrusion 28*b* which is adjoined to the left and right by two wings or hollows 28*c*, 28*d*. If the cleaning stick 21', inserted into the retaining channel 22 of the housing 2 via the quiver-like insertion opening 19, is turned, via the wings 28*c*, 28*d* at the head end of the stick shank 4, in the direction of an arrow 30 (FIG. 8*b* ) when the pencil 6 has likewise been inserted into the receiving channel 5, then the eccentric protrusion 28*b*, in the position according to FIG. 8*b*, clamps the pencil 6 in a manner analogous to the embodiment according to FIGS. 4 to 6. In this case, the wing or one hollow 28*c* butts against the pencil shank 6*a*. By virtue of the cleaning stick 21' being turned in the direction counter to the head of the arrow 30, until the other hollow-like wing 28*d* at least approximately butts against the pencil shank 6*a*, the clamping is eliminated again. In this position of the cleaning stick 21', the pencil 6, in turn, is freely rotatable and can be drawn out of the receiving channel 5. In a corresponding embodiment of the housing 2, the intermediate wall 24' between the retaining channel 22 and the receiving channel 5 is comparatively thick in relation to the wall thickness in the case of the embodiment according to FIGS. 9*a*–9*b*.

It is of critical importance here that the cleaning stick 21, 21', and also the above-described cleaning stick 20, 20', can be removed from the insertion opening or the retaining channel 22. This then reliably does away with the exertion of pressure and, following on from this, with the pencil 6 positioned in the receiving channel 5 being subjected to the influence of friction or clamping.

I claim:

1. A sharpener for shaping a use end of an item to be sharpened, comprising:

a housing having a receiving channel formed therein for receiving a use end of a marking implement having a shank;

a sharpening member disposed in said housing for shaping the marking implement; and a manually removable external clamping-force producer acting on said housing, said housing being seated as a protective cap, when not in use, with a clamping fit on the shank of the marking implement.

2. The sharpener according to claim 1, wherein said manually removable clamping-force producer is a functional part having a second use.

3. The sharpener according to claim 2, wherein said manually removable clamping-force producer is at least one of a cleaning stick, a shaping device for the use end of the marking implement, and a retaining clip retained on the shank of the marking implement.

4. The sharpener according to claim 1, wherein said housing has a retaining channel with a quiver-shaped insertion opening formed therein for receiving said manually removable external clamping-force producer, said manually removable external clamping-force producer configured for acting directly or indirectly on the shank of the marking implement.

5. The sharpener according to claim 4, wherein said housing has a pressure-exerting tongue flanking said receiving channel for engaging the use end of the marking implement and said pressure-exerting tongue having a side directed away from said receiving channel, and including a pressure-exerting lug for forcing said pressure-exerting tongue in a clamping direction and acts on said side of said pressure-exerting tongue directed away from said receiving channel.

6. The sharpener according to claim 5, wherein said pressure-exerting lug is connected to said manually removable external clamping-force producer.

7. The sharpener according to claim 6, wherein said pressure-exerting lug is a pressure-exerting wedge tapering in an insertion direction.

8. The sharpener according to claim 5, wherein said pressure-exerting tongue is an integral part of said housing.

9. The sharpener according to claim 8, wherein said pressure-exerting tongue is an intermediate wall which can be deformed radially inward in a direction of said receiving channel and disposed between said receiving channel and said retaining channel.

10. The sharpener according to claim 1, wherein said manually removable external clamping-force producer is an insertion/pivot pin and an eccentric positioned eccentrically on said insertion/pivot pin mounted rotatably in said housing.

11. The sharpener according to claim 10, wherein said receiving channel has an axis and said insertion/pivot pin in its insertion position runs substantially parallel to said axis of said receiving channel.

12. The sharpener according to claim 10, wherein in its insertion position, said eccentric of said manually removable external clamping-force producer is positioned outside of said housing.

13. The sharpener according to claim 10, wherein said manually removable external clamping-force producer is an oval eccentric plate having an eccentric side, a substantially centrally projecting eccentric protrusion disposed on said eccentric side, and a hollow-shaped wing adjoined on both sides of said substantially centrally projecting eccentric protrusion.

14. The sharpener according to claim 1, including an attachable shaving-collecting container, said receiving channel has an introduction opening and said housing has a housing side disposed opposite said introduction opening of in said receiving channel, said attachable shaving-collecting container disposed on said housing side.

15. The sharpener according to claim 14, wherein said attachable shaving-collecting container has a circumferential shape and said housing has a circumferential shape being the same as said circumferential shape of said attachable shaving-collecting container.

16. The sharpener according to claim 14, wherein said attachable shaving-collecting container is connected to said housing in a rotationally fixed manner.

17. The sharpener according to claim 14, wherein at least one of said housing and said attachable shaving-collecting container has an elliptical cross-sectional shape.

* * * * *